US010267297B2

(12) United States Patent
Livoti et al.

(10) Patent No.: US 10,267,297 B2
(45) Date of Patent: Apr. 23, 2019

(54) SELF-CALIBRATING RETURN SPRING PUMP, IN PARTICULAR SELF-CALIBRATING RETURN SPRING DOSING PUMP

(71) Applicant: Seko S.p.A., Cittaducale (IT)

(72) Inventors: Stefano Livoti, Cittaducale (IT); Walter Pitorri, Cittaducale (IT)

(73) Assignee: SEKO S.P.A., Santa Rufina, Cittaducale (IT)

( * ) Notice: Subject to any disclaimer, the term of this patent is extended or adjusted under 35 U.S.C. 154(b) by 242 days.

(21) Appl. No.: 14/910,151

(22) PCT Filed: Aug. 1, 2014

(86) PCT No.: PCT/IB2014/063609
§ 371 (c)(1),
(2) Date: Feb. 4, 2016

(87) PCT Pub. No.: WO2015/019258
PCT Pub. Date: Feb. 12, 2015

(65) Prior Publication Data

US 2016/0177930 A1 Jun. 23, 2016

(30) Foreign Application Priority Data

Aug. 5, 2013 (IT) ..... RM2013A0459

(51) Int. Cl.
*F04B 9/04* (2006.01)
*F04B 9/06* (2006.01)
(Continued)

(52) U.S. Cl.
CPC ..... *F04B 9/06* (2013.01); *F04B 9/042* (2013.01); *F04B 9/045* (2013.01); *F04B 13/00* (2013.01);
(Continued)

(58) Field of Classification Search
CPC .. F04B 9/042; F04B 9/045; F04B 9/06; F04B 13/00; F04B 19/22; F04B 43/02;
(Continued)

(56) References Cited

U.S. PATENT DOCUMENTS 3,151,778 A * 10/1964 Olney ..... B01F 15/0216 137/515
4,049,366 A * 9/1977 Becker ..... F04B 43/009 417/569
2002/0092505 A1* 7/2002 Rembold ..... F02M 37/0052 123/464

FOREIGN PATENT DOCUMENTS

DE 1653585 A1 12/1971
DE 102007059237 B3 2/2009

OTHER PUBLICATIONS

International Search Report for PCT/IB2014/063609 dated Aug. 1, 2014.

* cited by examiner

*Primary Examiner* — Philip E Stimpert
(74) *Attorney, Agent, or Firm* — PK Patent Law

(57) ABSTRACT

Self-calibrating return spring pump (300; 400), in particular self-calibrating return spring dosing pump, configured to carry out a volume pumping of a fluid (190) in a variable-volume front chamber (180), the self-calibrating pump (300; 400) being provided with a rear chamber (200) housed in a lantern (205) and with movable mechanical means (140, 150, 160; 140; 150) for forming a movable wall (170; 340) of the rear chamber (320) and for causing the movable wall (170; 340) of the rear chamber (320) to make a reciprocating motion when said movable mechanical means (140, 150, 160; 140; 150) interacts with cam or eccentric mechanical means (110), the front chamber (180) being configured to increase in volume when the rear chamber (200) decreases
(Continued)

in volume and vice versa, the pump further comprising elastic means (210) for elastic return of said movable mechanical means (140, 150, 160; 140; 150), the pump being characterised in that the rear chamber (320) is provided with one-way valve means (310) configured to allow air to pass only from the rear chamber (320) to the outside of the lantern (205), the rear chamber (320) being sealed and delimited by the movable wall (170; 340), by sealing means (330; 350), by internal walls of the lantern (205), and by said one-way valve means (310), whereby a pressure ppost within the rear chamber (320) is kept not higher than an ambient pressure Patm outside the lantern (205) and not higher than a pressure pa nt within the front chamber (180).

10 Claims, 3 Drawing Sheets

(51) Int. Cl.

| | |
|---|---|
| ***F04B 13/00*** | (2006.01) |
| ***F04B 19/22*** | (2006.01) |
| ***F04B 43/02*** | (2006.01) |
| ***F04B 53/10*** | (2006.01) |
| ***F04B 53/16*** | (2006.01) |

(52) U.S. Cl.
CPC ..... *F04B 19/22* (2013.01); *F04B 43/02* (2013.01); *F04B 53/10* (2013.01); *F04B 53/16* (2013.01)

(58) Field of Classification Search
CPC ..... F04B 53/10; F04B 53/16; F04B 43/0081; F04B 43/009
See application file for complete search history.

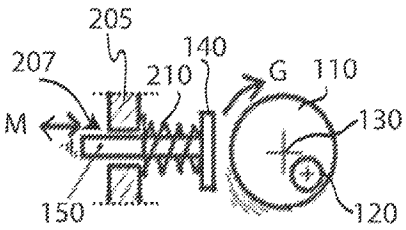
Fig. 1
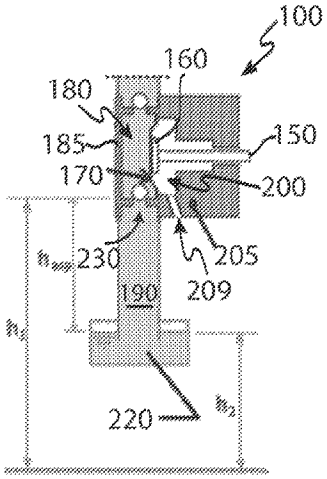
Fig. 2
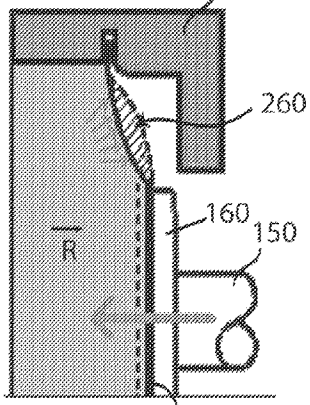
Fig. 4
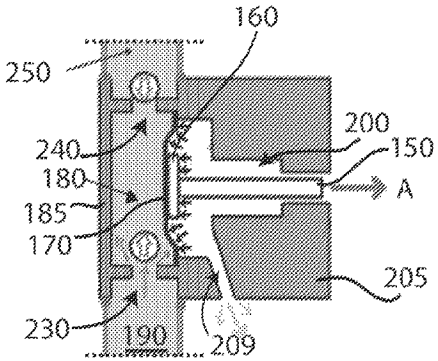
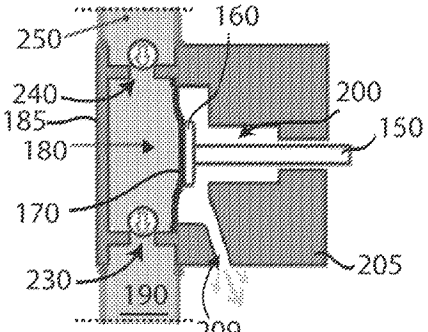
Fig. 3
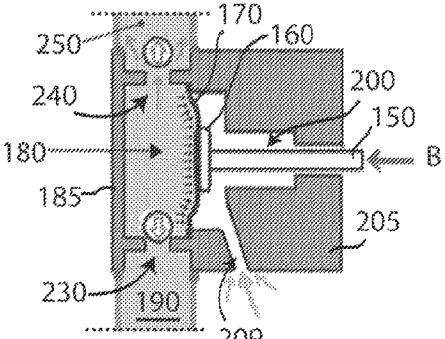

SELF-CALIBRATING RETURN SPRING PUMP, IN PARTICULAR SELF-CALIBRATING RETURN SPRING DOSING PUMP

This application is a national stage 35 U.S.C. 371 filing of International Application No. PCT/IB2014/063609, filed on Aug. 1, 2014. This application claims priority to Italian Patent Application No. RM2013A000459, filed on Aug. 5, 2013.

The present invention relates to a self-calibrating return spring pump, of the dry diaphragm or plunger piston type, in particular a self-calibrating return spring dosing pump, that allows allowing in a simple, reliable, efficient and inexpensive way to increase the speeds and accelerations of the mechanical components, simultaneously drastically reducing their deterioration and the noise produced during the operation of the pump, increasing the efficiency of the pump, and reducing the need for maintenance interventions.

In the following of the present description, reference will be mainly made to dosing pumps. However, it must understood that the self-calibrating return spring pump according to the invention may be also different from a dosing pump and used in any hydraulic circuit for applications different from mixing, still remaining within the scope of protection of the present invention.

It is known that mixing apparatuses are widespread. In particular, in the field of cleaning and disinfection of surfaces, such apparatuses allow both treatment exclusively with water and addition of concentrated chemical products, such as for instance disinfectants, soaps, wet foams and dry foams. Such apparatuses comprise dosing pumps which contribute to mixing the various substances with water and which are generally of two types: dry diaphragm pumps with cam or eccentric mechanism and return spring, and plunger piston pumps with return spring.

Making reference to FIGS. 1 and 2, it may be observed that a prior art dry diaphragm dosing pump 100 comprises a cam (or un eccentric), represented in FIG. 1 by a disc 110 rotating about an axis 120 offset with respect to the centre 130 of the disc 110, that interacts with a slab 140 integrally coupled to a piston 150 the head of which is provided with a plate 160 integrally coupled to a diaphragm 170 forming the movable wall of the front chamber 180 of the pump body 185 into which the effect of volume pumping of the liquid 190 (or other fluid) is achieved; in particular, the front surface of the diaphragm 170 is configured to get in contact with the liquid 190 pumped into the front chamber 180 of the pump body 185, while the rear surface of the same diaphragm 170, partially attached to the plate 160, is dry and facing a rear chamber 200 formed by the lantern 205. A spring 210 (or other elastic element), possibly preloaded, interposed between the slab 140 and a wall of the lantern 205 (into which a through hole 207 is made for allowing the piston 150 to pass) opposes the movement of the piston 150, and consequently of plate 160 and diaphragm 170, towards the front chamber 180 and exerts the elastic force causing the return of the same piston 150, and consequently of plate 160 and diaphragm 170, towards the cam 110 when allowed by the latter. In other words, the interaction of the various mechanical components of the pump makes the piston 150 executes a reciprocating motion (schematically represented in FIG. 1 with the bidirectional arrow M) when the cam 110 is put in rotation (schematically represented in FIG. 1 by the clockwise arrow G). The rear chamber 200, and consequently the rear surface of the diaphragm 170, is kept at air pressure by means of a through hole 209 present in the lantern 205. In particular, the FIG. 2 shows a prior art dry diaphragm dosing pump 100 in above head configuration, i.e. for a suction height $h_{asp}$ that is positive, where the suction height $h_{asp}$ is equal to the difference between the height $h_1$ of the suction inlet 230 (usually comprising a one-way valve) of the pump 100 and the height $h_2$ of the level of the liquid 190 within the reservoir 220:

$$h_{asp}=h_1-h_2>0$$

FIG. 3 schematically shows the typical operation of the pump 100 of FIGS. 1 and 2, wherein:

- FIG. 3*a* shows the incipient phase of return of the piston 150 (the movement of which, due to the force exerted by the spring 210, is schematically indicated by arrow A), and consequently of plate 160 and diaphragm 170, at the beginning of the phase of suction of the liquid 190 in the suction inlet 230 (wherein cui the liquid flow is schematically represented by the arrows crossing the inlet 230);
- FIG. 3*b* shows the temporary state of rest of the members of the pump 100 at the end of the suction phase (i.e. immediately before the delivery phase); and
- FIG. 3*c* shows the incipient pushing phase of the piston 150 (the movement of which, due to the force exerted by the cam 110, is schematically indicated by arrow B), and consequently of plate 160 and diaphragm 170, towards the front chamber 180 at the beginning of the phase of delivery of the liquid 190 out of the outlet 240 (usually comprising a one-way valve; the liquid flow is schematically represented by the arrows crossing the outlet 240).

In particular, in FIG. 3 the arrows present at the suction inlet 230 and on the delivery outlet 240 schematically represent the pressure differences between the two parts of the respective valves.

It is evident that the diaphragm 170 everts during suction (i.e. during the return of the plate 160 shown in FIG. 3*a*) because, though the air contained within the rear chamber 200 is expelled (i.e. though there is a pumping of the air towards the outside of the lantern 205), the rear pressure $p_{post}$ acting on the rear surface of the diaphragm 170 is equal to ambient pressure $P_{atm}$ and is higher than the pressure $p_{ant}$ on the front chamber 180 acting on the front surface of the diaphragm 170:

$$p_{post}=P_{atm}>p_{ant}$$

Differently, in the delivery phase (i.e. during the pushing phase of the plate 160 shown in FIG. 3*c*), the diaphragm 170 inflects because the pressure $p_{ant}$ within the front chamber 180 of the pump body 185 acting on the front surface of the diaphragm 170 is equal to the counterpressure of the circuit 250 downstream of the pump 100 that is higher than the rear pressure $p_{post}$ acting on the rear surface of the diaphragm 170, that is still equal to ambient pressure $P_{atm}$, notwithstanding that air is drawn from outside towards the rear chamber 200 of the lantern 205 (i.e. notwithstanding that there is a suction of air from the outside of the lantern 205).

Prior art dry diaphragm pumps with cam or eccentric mechanism and spring return suffer from some drawbacks.

First of all, such pumps have significant limits in speeds and accelerations possible for the components in reciprocating motion. In fact, an excessive speed and/or an acceleration do not guarantee the contact between slab 140 and cam 110 (or eccentric), achieving a condition known as "lost motion" condition causing impacts between slab 140 and cam 110 (or eccentric) and, consequently, a deterioration of the components of the pump 100 and a high noise. Such drawback is particularly significant during the suction phase.

Also, as schematically shown in FIG. 4, the diaphragm 170 undergoes the phenomenon of the pressure fluctuations due to the inversion of the direction of the resultant force $\vec{R}$ generated by the pressure difference acting on the front and rear surfaces of the same diaphragm 170: the volumetric efficiency of the pump reduces in function of the percentage related to the amount of liquid schematically indicated in Figure by the dashed volume 260 delimited by the diaphragm 170 in inflected configuration and in everted configuration, whereby at the beginning of the delivery phase the plate 160 moves for part of the stroke without producing any flow. This entails that the efficiency of the pump deteriorates in time, the lifetime of the diaphragm 170 is reduced and the pump needs frequent maintenance operations dedicated to the replacement of the same diaphragm 170.

All the aforementioned drawbacks are accentuated for the above head configuration of the pump (as that of FIG. 2).

In case of dosing plunger piston pumps with return spring, the mechanism is not provided with any diaphragm, but the head itself of the piston forms the movable wall of the front chamber of the pump body; the piston makes a reciprocating motion by crossing sealing means that seals the front chamber preventing the liquid (or other fluid) from entering the rear chamber, in which air is present and that communicates with the outside by means of a through hole of the lantern, similarly to what illustrated for the dry diaphragm dosing pump 100 of FIGS. 1-4.

Even the prior art dosing plunger piston pumps suffer from the drawback of having significant limits in speeds and accelerations possible for the components in reciprocating motion, otherwise the "lost motion" condition occurs.

In the prior art some solutions have been proposed for solving the aforementioned drawbacks of the dry diaphragm and plunger piston pumps, in particular for reducing wear of the mechanical components; some of these solutions are disclosed in documents GB543138A, GB1233351A, U.S. Pat. No. 3,715,174A, GB1503122A and US2012079718A1. However, such solutions make use of technical measures which render the pumps complex and expensive, and they do not completely solve the drawbacks illustrated above.

It is an object of this invention, therefore, to allow in a simple, reliable, efficient and inexpensive way to increase the speeds and accelerations of the mechanical components of a self-calibrating return spring pump, of the dry diaphragm or plunger piston type, simultaneously reducing the deterioration of the same mechanical components and the noise produced during the operation of the pump, increasing the efficiency of the pump, and reducing the need for maintenance interventions.

It is specific subject-matter of the present invention a self-calibrating return spring pump, in particular self-calibrating return spring dosing pump, configured to carry out a volume pumping of a fluid in a variable-volume front chamber, the self-calibrating pump being provided with a rear chamber housed in a lantern and with movable mechanical means for forming a movable wall of the rear chamber and for causing the movable wall of the rear chamber to make a reciprocating motion when said movable mechanical means interacts with cam or eccentric mechanical means, the front chamber being configured to increase in volume when the rear chamber decreases in volume and vice versa, the pump further comprising elastic means for elastic return of said movable mechanical means, the pump being characterised in that the rear chamber is provided with one-way valve means configured to allow air to pass only from the rear chamber to the outside of the lantern, the rear chamber being sealed and delimited by the movable wall, by sealing means, by internal walls of the lantern, and by said one-way valve means, whereby a pressure $p_{post}$ within the rear chamber is kept not higher than an ambient pressure $P_{atm}$ outside the lantern and not higher than a pressure $p_{ant}$ within the front chamber.

According to another aspect of the invention, said one-way valve means may comprise at least one one-way valve housed in at least one corresponding aperture of the lantern configured to put the rear chamber in communication with the outside of the lantern.

According to a further aspect of the invention, said sealing means delimiting the rear chamber may comprise at least one rear sealing gasket housed in a space of the lantern wherein said movable mechanical means is configured to make said reciprocating motion.

According to an additional aspect of the invention, said movable mechanical means may comprise a slab integrally coupled to a piston configured to make a reciprocating motion when the slab interacts with said cam or eccentric mechanical means.

According to another aspect of the invention, said elastic means for elastic return may be interposed between the slab and a wall of the lantern and it may be configured to exert an elastic force on the slab causing the piston to return towards said cam or eccentric mechanical means.

According to a further aspect of the invention, said elastic means for elastic return may comprise a spring, preferably a preloaded spring.

According to an additional aspect of the invention, the pump may be a dry diaphragm pump and said movable mechanical means may comprise a plate integrally coupled to a diaphragm forming the movable wall of the rear chamber, the diaphragm further forming a movable wall of the front chamber.

According to another aspect of the invention, the plate may be integrally coupled to the piston.

According to a further aspect of the invention, the pump may be a plunger piston pump and said movable mechanical means may comprise a head of a piston forming the movable wall of the rear chamber, the head further forming a movable wall of the front chamber, said sealing means delimiting the rear chamber comprising a front gasket surrounding the head.

According to an additional aspect of the invention, the head may be integrally coupled to the piston.

The advantages offered by the self-calibrating return spring pump according to the invention are evident.

First of all, the operation of the pump has reduced impacts of the cam mechanism, hence with less noise and less mechanical stress, even for high operating speeds and/or accelerations. In particular, the cam mechanism is not affected by any additional force produced by the depression within rear chamber with respect to the external ambient pressure, because this force is discharged on the pump body and on the lantern.

Also, in case of dry diaphragm pump, the diaphragm is preserved because it undergoes a lower pressure difference between the front and rear surfaces and it does not undergoes the phenomenon of pressure fluctuations.

Furthermore, by optimising the compression ratio in the rear chamber, even thanks to the elimination of the phenomenon of pressure fluctuations in case of dry diaphragm pump, it is possible to have an improvement of the volumetric efficiency, an improvement of the priming behaviour, higher possible heights for above head suction (under equal preload of the return spring) and a lower loss of flow when the suction height varies.

The present invention will be now described, by way of illustration and not by way of limitation, according to its preferred embodiments, by particularly referring to the Figures of the annexed drawings, in which:

FIG. 1 shows a schematic cross-sectional view of the return mechanism of the piston of a prior art dosing dry diaphragm pump;

FIG. 2 shows a schematic cross-sectional view of a prior art dosing dry diaphragm pump in above head configuration;

FIG. 3 shows three schematic cross-sectional views of three operation phases of the dosing pump of FIG. 2;

FIG. 4 shows a schematic cross-sectional view of a particular of the diaphragm of the pump of FIG. 2;

In the Figures identical reference numerals will be used for alike elements.

Figure 5:
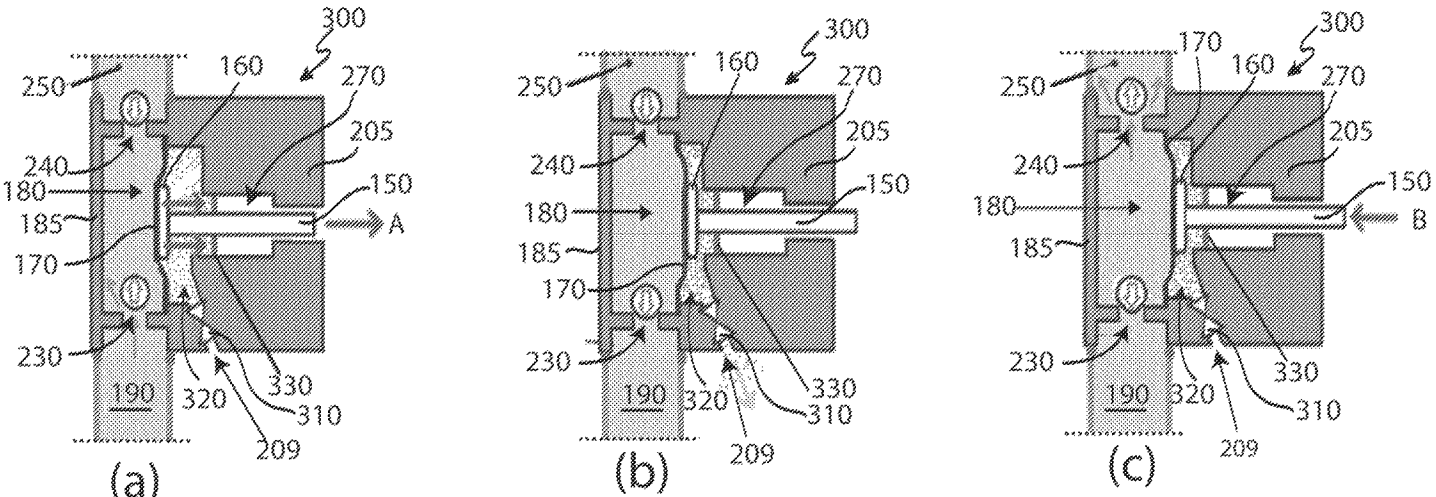
FIG. 5 shows three schematic cross-sectional views of three operation phases of a preferred embodiment of a self-calibrating return spring pump according to the invention.

With reference to FIG. 5, it may observed that a preferred embodiment of the self-calibrating return spring pump according to the invention is a dosing dry diaphragm pump 300. With respect to the prior art dry diaphragm pump of FIGS. 1-4, the pump 300 differs in that it is provided with a one-way valve 310 housed in the through hole 209 of the lantern 205 configured to allow air to pass only from the rear chamber 320 to the outside (and not vice versa); the rear chamber 320 is sealed by a rear sealing gasket 330 housed in the space 270 wherein the piston 150 makes the reciprocating motion, whereby the rear chamber 320 is delimited by the (rear surface of the) diaphragm 170 partially integrally coupled to the plate 160, that constitutes its movable wall, by the rear sealing gasket 330, by the internal walls of the lantern 205, and by the one-way valve 310. The other elements of the pump 300 of FIG. 5 are similar to those of the pump 100 of FIGS. 1-4.

In particular, FIG. 5 schematically shows the various operation phases of the pump 300, wherein:

FIG. 5*a* shows the incipient phase of return of the piston 150 (the movement of which, due to the force exerted by the spring—similar to the spring 210 of FIG. 1—is schematically indicated by arrow A), and consequently of plate 160 and diaphragm 170, at the beginning of the phase of suction of the liquid 190 in the suction inlet 230 (wherein cui the liquid flow is schematically represented by the arrows crossing the inlet 230);

Ia FIG. 5*b* shows the temporary state of rest of the members of the pump 300 at the end of the suction phase (i.e. immediately before the delivery phase); and Ia FIG. 5*c* shows the incipient pushing phase of the piston 150 (the movement of which, due to the force exerted by the cam—similar to the cam 110 of FIG. 1—, is schematically indicated by arrow B), and consequently of plate 160 and diaphragm 170, towards the front chamber 180 at the beginning of the phase of delivery of the liquid 190 out of the outlet 240 (wherein the liquid flow is schematically represented by the arrows crossing the outlet 240).

Also in FIG. 5 the arrows present at the suction inlet 230 and at the delivery outlet 240 schematically represent the pressure differences between the two parts of the respective valves.

It is evident that the air contained within rear chamber 320 is expelled through the valve 310 each time that the rear pressure $p_{post}$ acting on the rear surface of the diaphragm 170 tends to be higher than ambient pressure $P_{atm}$.

This entails that, at the end of the suction phase (FIG. 5*b*), the rear pressure $p_{post}$ acting on the rear surface of the diaphragm 170 is approximately equal to ambient pressure $P_{atm}$:

$$p_{post} \approx p_{ant}$$

In the delivery phase (i.e. during the pushing phase of the plate 160 shown in FIG. 5*c*), the rear pressure $p_{post}$ decreases from the value approximately equal to ambient pressure $P_{atm}$ down to a minimum value reached when the plate reaches the position shown in FIG. 5*a*, and then it increases again during the suction phase from such minimum value up to the value approximately equal to ambient pressure $P_{atm}$; in particular, such minimum value is variable in function of the conditions of pump operation, mainly in function of the air and/or pump temperature.

The one-way valve 310, permitting only the exit of the air from the rear chamber 320 to the outside, renders the pump 300 self-calibrating, in the sense that it maintains a rear pressure $p_{post}$ acting on the rear surface of the diaphragm 170 not higher than the pressure $p_{ant}$ within the front chamber 180 acting on the front surface of the diaphragm 170:

$$p_{post} \leq p_{ant}$$

In other words, the one-way valve 310 avoids that a positive pressure generates on the rear surface of the diaphragm 170 (with respect to the pressure $p_{ant}$ acting on the front surface of the diaphragm 170) whenever it is necessary, in particular: at power-up of the pump, in case of heating of the pump or environment, and in case of routine maintenance with replacement of the diaphragm 170.

During the suction phase, the retraction force generated by the "vacuum" (or better by the rear pressure $p_{post}$ lower than the front pressure $p_{ant}$ and not higher than ambient pressure $P_{atm}$) is variable in function of the position of the plate and effectively contributes to the return of the plate 160 and diaphragm 170 along with the return spring (that, on the contrary, acts alone in prior art dry diaphragm pumps).

In particular, the inventor has conducted some tests on dosing dry diaphragm pumps available from the Seko S.p.A. and he has ascertained that the retraction force generated by the "vacuum" reaches peaks of about 800 N.

Figure 6:
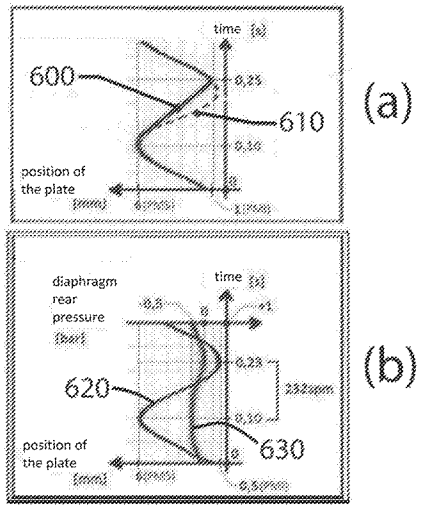
FIG. 6 shows some results of tests conducted on a dosing dry diaphragm pump respectively according to the prior art (FIG. 6*a*) and according to the invention (FIG. 6*b*)

FIGS. 6*a* and 6*b* show the behaviours detected by the oscilloscope through potentiometer and pressure transducer during tests to which a dosing pump MS1C165C of Seko S.p.A. has been subjected, with piston stroke of 6 mm, in above head configuration with $h_{asp}$=1.5 mm, with operation speed of 3.9 strokes/second (equal to 232 spm—strokes per minute), with the rear chamber respectively not provided (see FIG. 3) and provided (see FIG. 5) with the arrangement comprising the one-way valve 310 according to the teaching according to the invention. FIG. 6*a* shows (for the pump having the rear chamber not provided with the arrangement according to the invention, as shown in FIG. 3) the pattern 600 of the position of the plate 160 that does not follow in the suction phase the pattern 610 of the position of the cam 110. FIG. 6*b* (for the pump having the rear chamber provided with the arrangement according to the invention, as shown in FIG. 5) the pattern 620 of the position of the plate 160, that constantly follows the pattern of the position of the cam 110, and the pattern 630 of the rear pressure $p_{post}$ (referred to ambient pressure $P_{atm}$) of the rear chamber 320 acting on the rear surface of the diaphragm 170.

Moreover, the obtained operation has reduced impacts of the cam mechanism, hence less noise and less mechanical stress, even for high operating speeds and/or accelerations, such as for instance for operations with 3.9 strokes/second (232 spm—strokes per minute).

Figure 7:
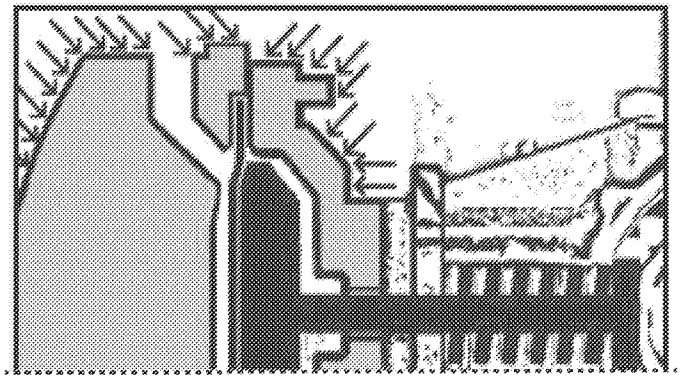
FIG. 7 shows a schematic cross-sectional view of a particular of the pump of FIG. 5.

In particular, the cam mechanism is not affected by any additional force produced by the depression within rear chamber 320 with respect to the external ambient pressure $P_{atm}$, because this force is discharged on the pump body 185 and on the lantern 205, as schematically shown by the arrows in FIG. 7.

Also, the diaphragm 170 is preserved because it undergoes a lower pressure difference between the front and rear surfaces and it does not undergoes the phenomenon of pressure fluctuations.

Furthermore, by optimising the compression ratio in the rear chamber, even thanks to the elimination of the phenomenon of pressure fluctuations, it is possible to have an improvement of the volumetric efficiency (the inventor has checked through the tests that it reaches at least 10%), an improvement of the priming behaviour, higher possible heights for above head suction (under equal preload of the return spring) and a lower loss of flow when the suction height varies (the inventor has checked through the tests that it reaches a maximum value of 2% per meter of water column).

Figure 8:
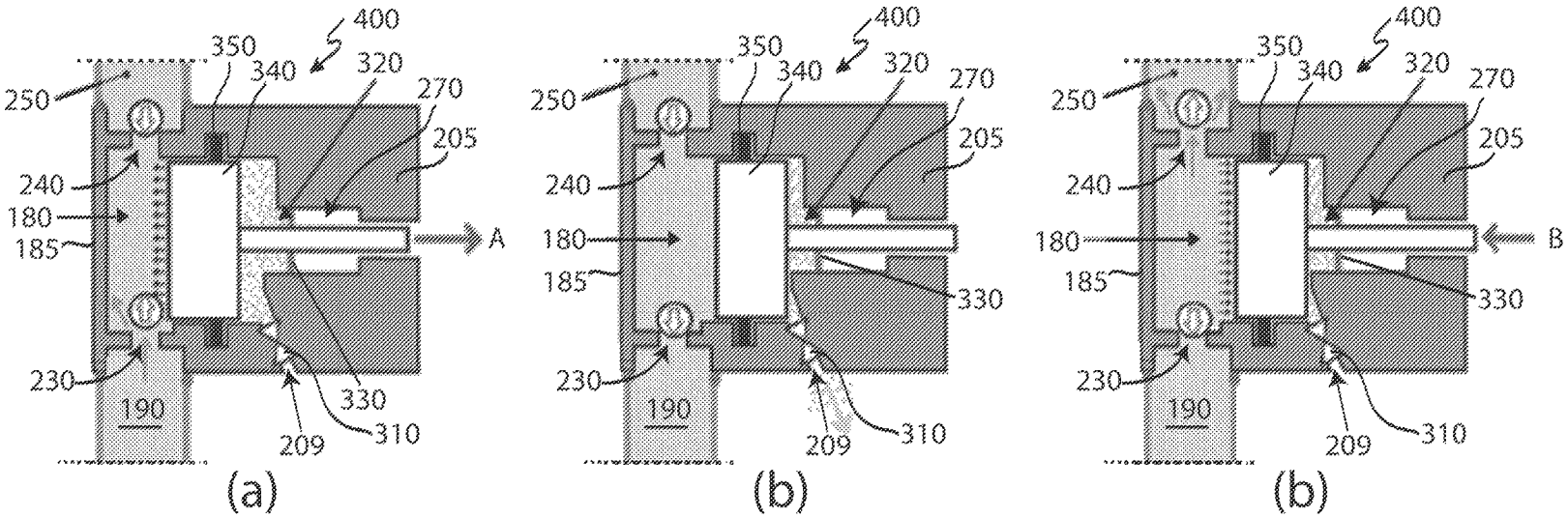
FIG. 8 shows three schematic cross-sectional views of three operation phases of a further embodiment of a self-calibrating return spring pump according to the invention.

With reference to FIG. 8, it may be observed that a further embodiment of the self-calibrating return spring pump according to the invention is a dosing plunger piston pump 400, that with respect to the dosing dry diaphragm pump 300 of FIG. 5 is not provided with any diaphragm, but wherein the movable wall of the front chamber 180 of the pump body 185 is formed by the head 340 of the piston 150; the piston 150 makes a reciprocating motion crossing sealing means, represented in FIG. 8 by a front sealing gasket 350 housed in a front portion of the lantern 205 and that surrounds the head 340, that seals the front chamber 180 preventing the liquid 190 (or other fluid) from entering the rear chamber 320. Similarly to what illustrated for the dosing dry diaphragm pump 300 of FIG. 5, even the plunger piston pump 400 is provided with a one-way valve 310 housed in the through hole 209 of the lantern 205 configured to allow air to pass only from the rear chamber 320 to the outside (and not vice versa), and the rear chamber 320 is sealed by a rear sealing gasket 330 housed in the space 270 wherein the piston 150 makes the reciprocating motion, whereby the rear chamber 320 is delimited by the (rear surface of the) head 340 of the piston 150 (wherein the head 340 constitutes the movable wall of the rear chamber 320), by the front and rear sealing gaskets 350 and 330, by the internal walls of the lantern 205, and by the one-way valve 310. The other elements of the pump 400 of FIG. 8 are similar to those of the pump 300 of FIG. 5.

In particular FIG. 8 schematically shows the various operation phases of the pump 300, wherein:

FIG. 8*a* shows the incipient phase of return of the piston 150 (the movement of which, due to the force exerted by the spring—similar to the spring 210 of FIG. 1—is schematically indicated by arrow A), and consequently of the head 340, at the beginning of the phase of suction of the liquid 190 in the suction inlet 230 (wherein cui the liquid flow is schematically represented by the arrows crossing the inlet 230);

FIG. 8*b* shows the temporary state of rest of the members of the pump 400 at the end of the suction phase (i.e. immediately before the delivery phase); and FIG. 8*c* shows the incipient pushing phase of the piston 150 (the movement of which, due to the force exerted by the cam—similar to the cam 110 of FIG. 1—, is schematically indicated by arrow B), and consequently of the head 340, towards the front chamber 180 at the beginning of the phase of delivery of the liquid 190 out of the outlet 240 (wherein the liquid flow is schematically represented by the arrows crossing the outlet 240).

Once again, in FIG. 8 the arrows present at the suction inlet 230 and at the delivery outlet 240 schematically represent the pressure differences between the two parts of the respective valves.

Even in the case of the dosing plunger piston pump 400 with return spring mechanism the same benefits of the dry diaphragm pump 300 (with the exception of those related to diaphragm, such as pressure fluctuations) are obtained.

Other embodiments of self-calibrating return spring pump according to the invention may comprise mechanical means configured to make a reciprocating motion when interacting with cam or eccentric mechanical means, so as to form a movable wall of the rear chamber 320, different from the slab 140 and piston 150 and, for the arrangement of FIG. 5, from the diaphragm 170 or from the head 340 of the piston 150 of FIG. 8, still remaining within the scope of protection of the present invention; by way of example and not by way of limitation, the single piston 150 may be replaced by linkages and/or gears, and/or the single diaphragm 170 of the arrangement of FIG. 5 may be replaced with two or more diaphragms or with one diaphragm and one or more walls or plates. Also the cam or eccentric mechanical means may be different from those represented in FIG. 1. Moreover, in the arrangement of FIG. 8, the sealing means that seals the front chamber 180 preventing the liquid 190 (or other fluid) from entering the rear chamber 320 may be different from the arrangement comprising the single front sealing gasket 350 housed in a front portion of the lantern 205 and that surrounds the head 340; by way of example and not by way of limitation, such sealing means may be two or more gaskets and/or the front sealing gasket 350 may be housed in a groove on the side surface of the head 340 (and that surrounds the head 340) and, consequently, movable with the same.

Further embodiments of self-calibrating return spring pump according to the invention may comprise elastic means for elastic return of the piston 150 different from the spring (schematically indicated with the reference numeral 210 in FIG. 1).

Other embodiments of self-calibrating return spring pump according to the invention may comprise other one-way valve means configured to allow air to pass only from the rear chamber 320 to the outside (and not vice versa) even different from the one-way valve 310 housed in the through hole 209 of the lantern 205.

The preferred embodiments of this invention have been described and a number of variations have been suggested hereinbefore, but it should be understood that those skilled in the art can make variations and changes, without so departing from the scope of protection thereof, as defined by the attached claims.

The invention claimed is:

1. A self-calibrating return spring pump configured to carry out a volume pumping of a fluid in a variable-volume front chamber, the self-calibrating pump comprising: a rear chamber formed by a pump housing and arranged with a movable mechanical structure including a movable wall, the movable wall of the rear chamber configured to make a reciprocating motion when said movable mechanical structure interacts with a cam or eccentric mechanical structure such that the front chamber is configured to increase in volume when the rear chamber decreases in volume and configured to decrease in volume when the rear chamber increases in volume, the pump further including a spring for elastic return of said movable mechanical structure, wherein the rear chamber is provided with a one-way valve, the rear chamber being sealed and delimited by the movable wall, by sealing structure, by internal walls of the pump housing, and by said one-way valve, whereby due to the movable wall being reciprocated by said movable mechanical structure thereby varying the volume of the rear chamber a pressure $p_{post}$ within the rear chamber is kept not higher than an ambient pressure $P_{atm}$ outside the pump housing and not higher than a pressure $p_{ant}$ within the front chamber by way of the one-way valve being configured to allow air to pass only from the rear chamber to the outside of the pump housing.

2. The self-calibrating return spring pump according to claim 1, wherein said one-way valve is housed in at least one corresponding aperture of the pump housing and configured to put the rear chamber in communication with the outside of the pump housing.

3. The self-calibrating return spring pump according to claim 1, wherein said sealing structure delimiting the rear chamber includes at least one rear sealing gasket housed in a space of the pump housing wherein said movable mechanical structure includes a piston configured to reciprocate and to transfer reciprocating motion to said movable wall of the rear chamber.

4. The self-calibrating return spring pump according to claim 1, wherein said movable mechanical structure includes a slab integrally coupled to a piston and configured to make a reciprocating motion when the slab interacts with said cam or eccentric mechanical structure.

5. The self-calibrating return spring pump according to claim 4, wherein said spring is interposed between the slab and one of the internal walls of the pump housing and is configured to exert an elastic force on the slab causing the piston to return towards said cam or eccentric mechanical structure.

6. A self-calibrating return spring dry diaphragm pump configured to carry out a volume pumping of a fluid in a variable-volume front chamber, the self-calibrating pump comprising: a rear chamber formed by a pump housing and arranged with a movable mechanical structure including a plate integrally coupled to a diaphragm forming a movable wall of the rear chamber, wherein the movable mechanical structure is configured to cause the movable wall of the rear chamber to make a reciprocating motion when said movable mechanical structure interacts with a cam or eccentric mechanical structure such that the front chamber is configured to increase in volume when the rear chamber decreases in volume and configured to decrease in volume when the rear chamber increases in volume, the pump further including a spring for elastic return of said movable mechanical structure, wherein the rear chamber is provided with a one-way valve, the rear chamber being sealed and delimited by the movable wall, by sealing structure, by internal walls of the pump housing, and by said one-way valve, whereby due to the movable wall being reciprocated by said movable mechanical structure thereby varying the volume of the rear chamber a pressure $p_{post}$ within the rear chamber is kept not higher than an ambient pressure $P_{atm}$ outside the pump housing and not higher than a pressure $p_{ant}$ within the front chamber by way of the one-way valve being configured to allow air to pass only from the rear chamber to the outside of the pump housing.

7. The self-calibrating return spring dry diaphragm pump according to claim 6, wherein said movable mechanical structure includes a slab integrally coupled to a piston configured to make a reciprocating motion when the slab interacts with said cam or eccentric mechanical structure, and wherein the plate is integrally coupled to the piston.

8. A self-calibrating return spring plunger piston pump configured to carry out a volume pumping of a fluid in a variable-volume front chamber, the self-calibrating pump comprising: a rear chamber formed by a pump housing and arranged with a movable mechanical structure including a head of a piston forming a movable wall of the rear chamber, wherein the movable mechanical structure is configured to cause the movable wall of the rear chamber to make a reciprocating motion when said movable mechanical structure interacts with a cam or eccentric mechanical structure such that the front chamber being configured to increase in volume when the rear chamber decreases in volume and configured to decrease in volume when the rear chamber increases in volume, the pump further including a spring for elastic return of said movable mechanical structure, wherein the rear chamber is provided with a one-way valve, the rear chamber being sealed and delimited by the movable wall, by sealing structure including a front gasket surrounding the head, by internal walls of the pump housing, and by said one-way valve, whereby due to the movable wall being reciprocated by said movable mechanical structure thereby varying the volume of the rear chamber a pressure $p_{post}$ within the rear chamber is kept not higher than an ambient pressure $P_{atm}$ outside the pump housing and not higher than a pressure $p_{ant}$ within the front chamber by way of the one-way valve being configured to allow air to pass only from the rear chamber to the outside of the pump housing.

9. The self-calibrating return spring plunger piston pump according to claim 8, wherein said movable mechanical structure includes a slab integrally coupled to a piston configured to make a reciprocating motion when the slab interacts with said cam or eccentric mechanical structure, and wherein the head is integrally coupled to the piston.

10. The self-calibrating return spring pump according to claim 1, wherein said spring is a preloaded spring.

* * * * *